US007202453B2

(12) United States Patent
Charlier De Chily et al.

(10) Patent No.: US 7,202,453 B2
(45) Date of Patent: Apr. 10, 2007

(54) ENERGY APPLICATORS ADAPTED TO DIELECTRIC HEATING

(75) Inventors: Pierre Charlier De Chily, Irigny (FR); Mikaele Raynard, Saint-Brevin les Pins (FR)

(73) Assignee: ALDVIA S.A., Saint-Genis Laval (FR)

( * ) Notice: Subject to any disclaimer, the term of this patent is extended or adjusted under 35 U.S.C. 154(b) by 0 days.

(21) Appl. No.: 10/482,778

(22) PCT Filed: Jun. 28, 2002

(86) PCT No.: PCT/FR02/02272

§ 371 (c)(1),
(2), (4) Date: Sep. 15, 2004

(87) PCT Pub. No.: WO03/005772

PCT Pub. Date: Jan. 16, 2003

(65) Prior Publication Data

US 2005/0029253 A1 Feb. 10, 2005

(30) Foreign Application Priority Data

Jul. 2, 2001 (FR) ..... 01 08906

(51) Int. Cl.
*H05B 6/70* (2006.01)
*H01P 1/00* (2006.01)

(52) U.S. Cl. ..... 219/690; 333/248

(58) Field of Classification Search ..... 219/690, 219/678, 691, 696, 697; 333/248, 245, 249, 333/250, 253

See application file for complete search history.

(56) References Cited

U.S. PATENT DOCUMENTS 4,320,716 A 3/1982 Kaplan et al.

(Continued)

FOREIGN PATENT DOCUMENTS

FR 2 643 829 9/1990
JP 61-281433 12/1986

OTHER PUBLICATIONS

Morita Y. Et al, "Fabrication of SIN Films at Low Temperature By RF Biased Coaxial-Line Microwave Plasma CVD", Electronics & Commiuunications in Japan Part II—Electronics, Scripta Technica vol. 79, No. II (Nov. 1, 1996) pp. 58-65.

*Primary Examiner*—Daniel Robinson
(74) *Attorney, Agent, or Firm*—Oblon, Spivak, McClelland, Maier & Neustadt, P.C.

(57) ABSTRACT

A dielectric heating system with which the power density applied to the product being treated can be at least doubled without risk of electric arcs. This invention is particularly suitable for treatment of compounds that absorb electromagnetic waves weakly (low dielectric constants). In particular, fatty substances such as oils, butters, waxes and fats can be treated (refining, hydrolysis, transesterification, interesterification, etc.), derivatives thereof (esterification, polymerization, alcoholysis, ethoxylation, hydrogenation, etc.) under static or dynamic conditions, as can hydrocarbons and aromatic compounds. This system can also be used advantageously for polar or polarized compounds, because the power absorbed is increased very significantly, with large production gains. In particular, fatty or non-fatty alcohols (oleic alcohol, glycol, glycerol, mannitol, sorbitol, polyglycerols, vitamins, etc.), carboxylic acids, amines and similar compounds can be treated under static or dynamic conditions.

29 Claims, 15 Drawing Sheets

U.S. PATENT DOCUMENTS 4,549,053 A * 10/1985 Haugh ..... 219/686
5,146,058 A * 9/1992 Herfindahl et al. ..... 219/693
5,523,548 A * 6/1996 Tsukagoshi et al. ..... 219/695
5,607,710 A * 3/1997 De Ruyter et al. ..... 426/237
5,911,885 A * 6/1999 Owens ..... 210/748
6,111,237 A * 8/2000 Paustian ..... 219/687
6,246,037 B1 6/2001 Drozd et al.
6,614,010 B2 * 9/2003 Fagrell et al. ..... 219/690

* cited by examiner

ENERGY APPLICATORS ADAPTED TO DIELECTRIC HEATING

TECHNICAL FIELD OF THE INVENTION AND PROBLEM POSED

The present invention relates to the design and use of energy applicators, and more particularly to resonant cavities and chimney members of shapes and dimensions adapted to the dielectric heating of any compound, regardless of the dielectric constants thereof.

The usual microwave and high-frequency applicators are equipped with traditional chimney members that make it impossible to work at high power density without the risk of electric arcs. The purpose of the chimney members used by the person skilled in the art is aimed at subjecting a product (liquid, solid, gaseous or a mixture of the three states) to electromagnetic waves under static or dynamic conditions, while preventing waves from leaking out of the waveguide. The chimney members, of traditional shape, preferably of cylindrical shape, make it impossible to reach the desired temperature level rapidly and/or to treat a larger quantity of product without the risk of electric arcs. In contrast to polar or polarized molecules, for which energy transfer is optimum, a high power density proves to be necessary to achieve heating of compounds, characterized by low dielectric constants, that absorb electromagnetic waves weakly.

Thus there exists a serious technical problem, posed by the risks of "discharge" or electric arcs and the industrial consequences thereof, which problem represents a major concern in industry, because of the importance of the industrial applications indicated here. By virtue of the invention, the time for processing the products can be very greatly shortened and, in parallel, the industrial efficiency can be improved.

SUMMARY OF THE INVENTION

After numerous attempts, the Applicant has discovered a new shape or geometry for the chimney member, in particular a chimney member of conical shape or geometry, that makes it possible to heat any type of product at microwave frequencies or high frequencies under static or dynamic conditions with a high power density without risk of electric arcs or "discharge".

APPLICATIONS

The invention makes it possible to achieve heat treatments of compounds that absorb electromagnetic waves weakly in a manner that is just as efficient and rapid as for polar or polarized compounds. The time and energy savings, combined with a lower investment cost, make it possible to ensure that the applications with dielectric heating are faster and more economical.

The invention relates in particular, but non-limitatively, to the treatment of fatty acid esters (unsaturated or otherwise), of hydrocarbons (unsaturated or otherwise), of aromatic compounds and of derivatives of the latter. It is also of great interest, however, for products that strongly absorb electromagnetic waves, because it makes it possible to increase the production capacity of a given system (fatty and non-fatty alcohols, carboxylic acids, amines, etc.).

The present invention relates to all the heating applications involving a single reactant or a mixture of reactants in variable proportions, with or without catalysts, with or without process or "working" gas. Non-limitative examples of heating applications include esterification, transesterification, epoxidation, sulfatization, phosphatization, hydrogenation, peroxidation, isomerization, dehydration, quaternization, amidification, polymerization and polycondensation reactions as well as all the usual treatments such as decolorization, deodorization and the other systems for elimination of volatile compounds.

In fact, the invention is applicable quite particularly to all reactions of "lipochemistry", and notably has a very strong interest for the case of products that absorb electromagnetic waves weakly.

This innovative technique makes it possible, for example, to synthesize polymers of unsaturated fatty acids, of esters of unsaturated fatty acids, of unsaturated hydrocarbons or of derivatives of such products by means of dielectric heating with microwaves. On this subject the Applicant has filed French Patent Application 98-13770 and PCT Patent Application WO 00/26265 (PCT/FR99/02646).

PRIOR ART

The technical field of the present invention relates to the use of microwave or high-frequency electromagnetic waves both for heating applications on compounds that absorb radiation weakly and on compounds with high dielectric constants.

The microwave (MW) frequencies range between about 300 MHz and about 30 GHz, preferably 915 MHz (authorized frequency with a tolerance of 1.4%) or 2.45 GHz (authorized frequency with a tolerance of 2%).

The high frequencies (HF) range between about 3 MHz and about 300 MHz, preferably 13.56 MHz (authorized frequency with a tolerance of 0.05%) or 27.12 MHz (authorized frequency with a tolerance of 0.6%).

The power (in watts) absorbed by a material under HF or MW treatment is given by the following formula:

$$Pa=kf\epsilon''E^2V$$

With:

Pa: power absorbed in W.

E: electric field created in the material in V/cm.

f: frequency of the waves.

K: constant (M.K.S.A)=$5.56.10^{-13}$

V: volume of the material in $cm^3$.

$\epsilon''$: material loss factor=$\epsilon'$ tan $\delta$ $\epsilon'$: real relative permittivity of the material=$\epsilon_0 * \epsilon_R$ $\epsilon_0$: permittivity of vacuum $\epsilon_R$: dielectric constant tan $\delta$: loss angle $\epsilon'$ represents the tendency of a material to become oriented in the field and tan $\delta$ represents its capacity to dissipate heat.

Remark: for air or vacuum, $\epsilon'=1$ (which is the lowest value for $\epsilon'$) and tan $\delta=0$, meaning that $\epsilon''=0$.

Let us consider a system comprising a guide designed to carry waves corresponding to a given frequency. The product to be heated is placed in a reactor of material that does not absorb the waves (Pyrex, quartz, etc.). This reactor is positioned inside the applicator formed from single-mode cavities that resonate at the emission frequency along a beam in the direction of the waveguide. The microwave applicator is equipped with chimney members, traditionally cylindrical to conform to the shape of the reactor being used (see FIGS. 1, 2, 3). The purpose of these chimney members is to prevent waves from leaking out of the waveguide. The discharge phenomenon occurs in zones where the tube containing the product to be treated develops disruptive voltages, or in other words where the accumulated energy is such that ionization of the medium (electric spark) occurs. The electric field is characterized by the ratio of the voltage between two points to the distance separating these two points. The risks of discharge occur in the zones where the field is too concentrated.

The reactor can traverse the waveguide at right angles to the direction of propagation of the waves or else parallel to the direction of the waves (see FIGS. 2 and 12). The person skilled in the art will understand that these two positions are not the only possible configurations and that the invention encompasses all other intermediate positions.

Reactants:

For the present invention, the reactant or reactants can be chosen from among the products that absorb electromagnetic waves weakly or the products that absorb strongly or a mixture of the two, with or without additions of one or more catalysts or weakly or strongly absorbing additives and/or of process gas.

Among the strongly absorbing products there will be understood fatty or non-fatty alcohols, fatty or non-fatty amines, carboxylic acids, acetals, ketones, enols, peracids, epoxides and, more generally, chemical compounds containing a polar or polarized function, especially

- as alcohols: sorbitol, glycerol, mannitol, glycols, vitamins (such as tocopherol, ascorbic acid, retinol), polyphenols, sterols (including the phytosterols) and analogous compounds, and,
- as amines: ammonia, primary, secondary and tertiary alkylamines (such as methylamine, dimethylamine, trimethylamine, diethylamine), fatty amines (such as oleic amines, alkylamines of coconut oil), aminoalcohols (such as monoethanolamine MEA, diethanolamine DEA, triethanolamine TEA; 3-amino-1,2-propanediol, 1-amino-2-propanol) and ethoxylated amines (2,2'-aminoethoxyethanol; amino-1-methoxy-3-propane).

All of these amines may be saturated or unsaturated, straight-chain or branched.

Among the catalysts or additives there will be understood, as non-limitative examples, the usual acid catalysts (paratoluenesulfonic acid, sulfuric acid, phosphoric acid, perchloric acid, etc.), the usual basic catalysts (sodium hydroxide, potassium hydroxide, alkali metal and alkaline earth alcoholates, sodium acetate, triethylamines, pyridine derivatives, etc.), the acid and/or basic resins of the Amberlite™, Amberlyst™, Purolite™, Dowex™ and Lewatit™ type, zeolites, enzymes, carbon blacks and activated carbon fibers.

Among the weakly absorbing products there will be understood the animal or vegetable oils and fats and the polyterpenes, some of which are derived from the said oils and fats.

Oils or Fats of Animal Origin

As oils or fats of animal origin there can be cited, among others, sperm oil, dolphin oil, whale oil, seal oil, sardine oil, herring oil, shark oil, cod-liver oil, neatsfoot oil and beef, pork, horsemeat and mutton fats (suets).

Oils of Vegetable Origin

As oils of vegetable origin there can be mentioned, among others, rapeseed oil, sunflower-seed oil, peanut oil, olive oil, walnut oil, corn oil, soybean oil, linseed oil, safflower-seed oil, apricot-kernel oil, sweet-almond oil, hemp oil, grape-seed oil, coconut oil, palm oil, cottonseed oil, babassu oil, jojoba oil, sesame oil, argan oil, milk-thistle oil, pumpkin-seed oil, raspberry oil, Karanja oil, Neem oil, poppy-seed oil, Brazil-nut oil, castor oil, dehydrated castor oil, hazelnut oil, wheat-germ oil, borage oil, onager oil, Tung oil and tall oil.

Components of Animal or Vegetable Oils

It is also possible to use components of animal or vegetable oils, such as squalene, which is extracted from the unsaponifiable fractions of vegetable oils (olive oil, peanut oil, rapeseed oil, corn-germ oil, cottonseed oil, linseed oil, wheat-germ oil, rice-bran oil) or contained in large quantity in shark oil.

These oils and fats of animal or vegetable origin as well as the derivatives thereof can be subjected to a preliminary treatment aimed at making them more reactive or, on the other hand, less reactive. The invention relates both to an isolated reactant and to a reaction mixture containing two or more components. These reaction mixtures may contain equivalent proportions of each component, or certain components may predominate.

Unsaturated Hydrocarbons

As unsaturated hydrocarbons there can be cited, as single substances or as mixtures, and as non-limitative examples, an alkene, such as a terpenoid hydrocarbon or hydrocarbons, meaning a polymer or polymers of isoprene, or a polymer or polymers of isobutene, styrene, ethylene, butadiene, isoprene or propene, or a copolymer or copolymers of these alkenes.

Type of Energy Applicator

The choice of energy applicator depends on the technology used (high-frequency or microwave), on the dimensional characteristics of the product to be treated and on the method of treatment thereof.

In the case of polar or polarized molecules, for which energy transfer is optimum, there exists a certain number of standard applicators that have proved their effectiveness.

High-frequency applicators include essentially:

- applicators of capacitive type, formed from two capacitor foils between which there is applied the high-frequency voltage of the generator. They are used for heat treatment of materials whose volume comprises a parallelepiped in which one of the sides is sufficiently thick (>10 mm).
- rod applicators for flat materials, comprising tubular or rod electrodes. They are used for heat treatment of materials whose volume comprises a parallelepiped in which one of the sides is not sufficiently thick (<10 mm).

Applicators for thread-like materials, formed of loops.

For the microwave applicators, there can be cited:

localized-field applicators: single-mode cavity diffuse-field applicators: multimode cavity near-field applicators: radiating-antenna guide In the case of weakly absorbing molecules, the choice of applicators is more complicated. In fact, the applicator must transmit much more electromagnetic energy to the product in order to heat it, while avoiding electric arcs.

Heating at microwave frequencies is preferred to high frequencies, for which the risk of discharge is greater. In fact, the loss factor $\epsilon''$ and the frequency are lower in this case. For equivalent absorbed power, and in keeping with the formula presented hereinabove, the electric field increases, thus increasing the risk of discharge.

A resonant microwave system is recommended: it may be a localized-field or a diffuse-field applicator. Nevertheless, the "single-mode" system (localized field), which is formed from single-mode cavities resonating at the emission frequency along a beam in the direction of the guide, is preferred to the multimode" system (diffuse field). The single-mode system avoids inhomogeneous distribution of the electric field and the presence of hot spots. Similarly, this type of reactor favors the stability of the exposed products.

The person skilled in the art will understand that dielectric heating of compounds that absorb electromagnetic waves weakly is not limited to the single-mode microwave system. Nevertheless, this system reduces the risk of electric arcs and permits better control of heat treatments.

The chimney members usually used in the single-mode applicators have straight cylindrical shape, in order to conform more closely to the shape of the traditionally used reactors (see FIG. 3).

The chimney members are placed on both sides of the waveguide in order to prevent waves from leaking out in the case of tests under dynamic conditions (see FIG. 2). The length of each chimney member is determined so as to exclude any leakage of waves and to comply with the safety measures relating to personnel and telecommunications. The French standards are currently identical to the British, German and U.S. standards. These standards are generally less stringent for HF than for MW applications: 10 $mW/cm^2$ and 5 $mW/cm^2$ at 1 inch from the equipment. For the usual cylindrical chimney members, the height is related to the material permittivity and reactor diameter by empirical relationships.

For reasons of simplicity and better control of the resonant cavity, the chimney members placed on both sides of the waveguide have identical shape.

The present invention shows that the single-mode applicator equipped with the standard cylindrical chimney members, the most suitable of all standard applicators for weakly absorbing molecules, makes it impossible to work with high power density without the risk of discharge.

An intricate means of alleviating the problems related to weakly absorbing compounds would be to introduce polar compounds such as water into the reaction medium, to act as energy-transfer agent and thus to reduce the necessary power density. This alternative is not satisfactory, however, inasmuch as undesired secondary reactions may occur, and additional treatments such as neutralization, washing, drying or filtration may be necessary to purify the product at the end of reaction.

One alternative for alleviating the problems related to weakly absorbing compounds is to remove the static electricity as soon as it develops on the outside wall of the reactor. For a product that absorbs electromagnetic waves weakly and for a given incident power Pi, the absorbed power Pa decreases and the losses increase, especially those due to static electricity.

In fact:

$$Pi = Pa + \text{losses}$$

With:

Pi=incident power in W

Pa=absorbed power in W

Losses=heat losses+static electricity

Static electricity is manifested by ionization of molecules of the air. It accumulates on the nonconductive outside walls of the reactor until an electric arc develops. To remove the static electricity, it is necessary either to promote good ventilation by humid air or by another gas having comparable values of dielectric constants (such as sulfur hexafluoride SF6 at 1 bar) ($1^{st}$ solution), or to adapt the shape of the chimney members in such a way that they are open to the air ($2^{nd}$ solution). The first solution does not seem advantageous for reasons of installation complexity, safety and cost.

Thus there exists a large and recognized need to improve the known energy applicators, and in particular to adapt them non-limitatively to the field of the process and reactants of the present invention.

DESCRIPTION OF THE INVENTION

Figure 1:
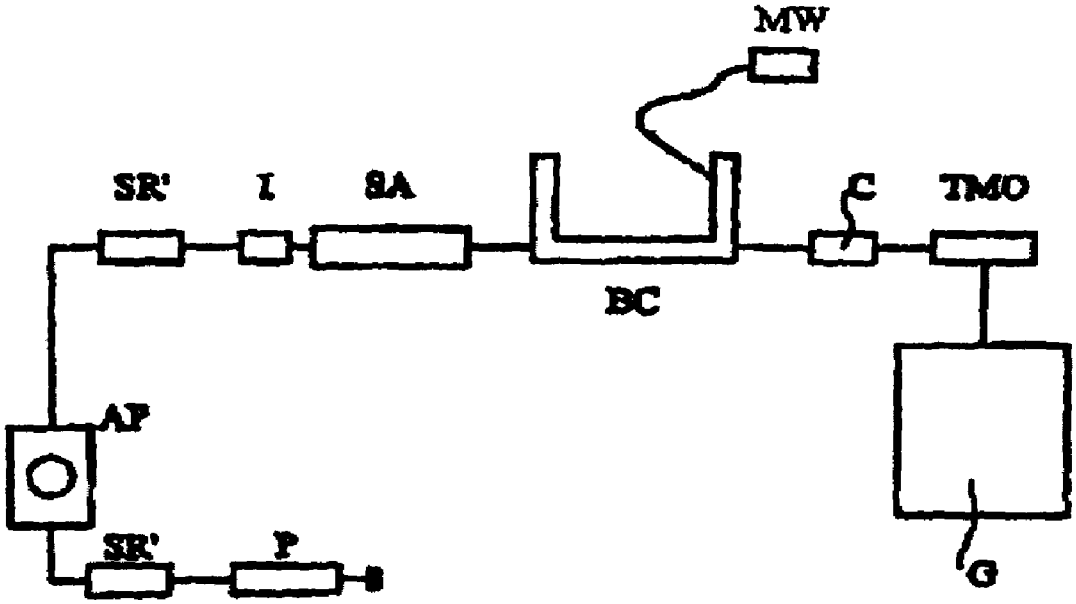
FIG. 1 is a block diagram of a microwave device according to one embodiment of the present invention.
Figure 2:
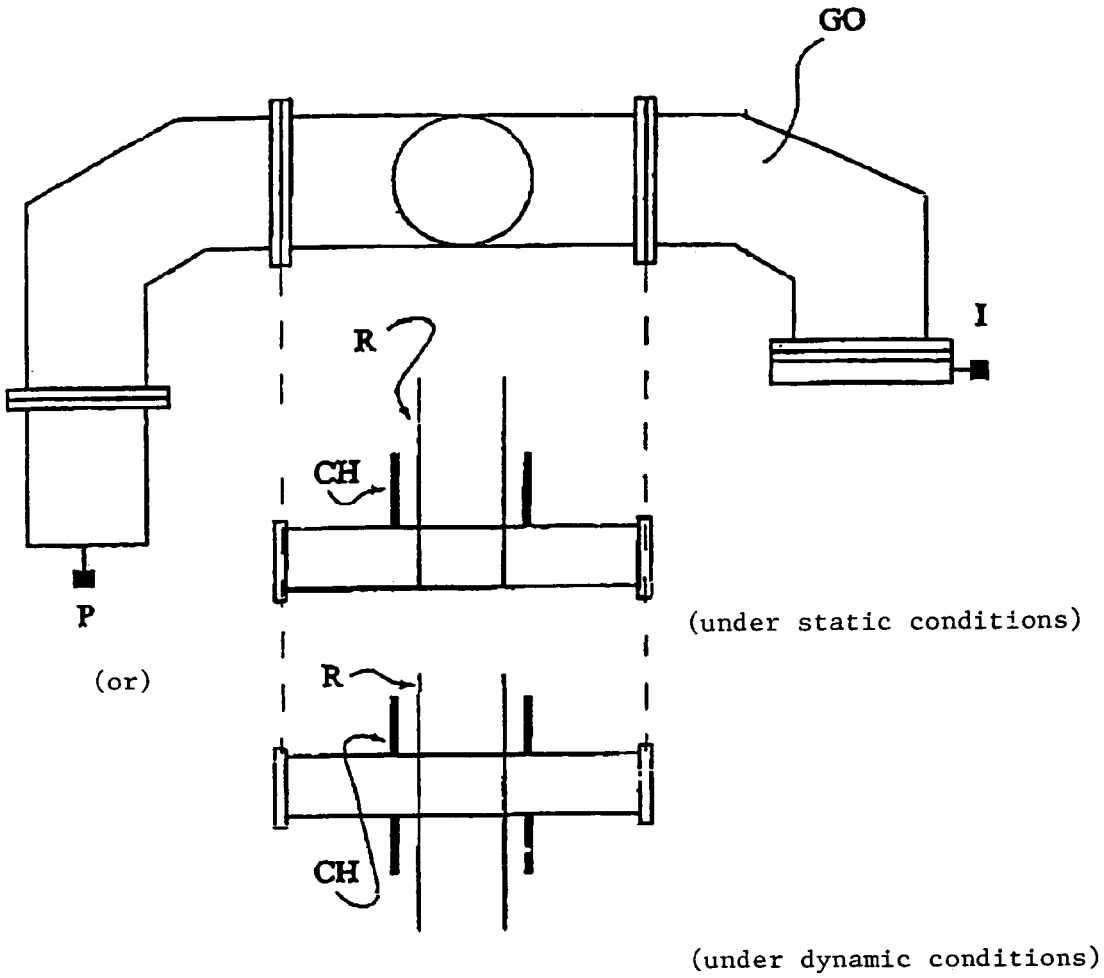
FIG. 2 is a diagram of a microwave applicator equipped with chimney members according to one embodiment of the present invention.

The Applicant has discovered a new shape or geometry for the chimney member, especially a conical chimney member, which makes it possible to heat any type of product at microwave frequencies or high frequencies under static or dynamic conditions at high power density without risk of electric arcs or "discharge".

More generally, the Applicant has discovered that it is desirable to provide a resonant cavity that extends around the waveguide, for treatment of the product (in other words to create an "additional" resonant cavity around that present in the waveguide), and in particular to provide one or more chimney members around or on each side of the waveguide, preferably with identical geometry and adapted so as to form a resonant cavity extending around the waveguide, for treatment of the product under consideration.

Thus the invention relates in general to an energy applicator, of the type comprising a waveguide and lateral chimney members, for dielectric heating of any compound, at microwave frequencies or high frequencies, under static or dynamic conditions, at relative power density higher than that of the usual applicators, without risk of electric arcs or "discharge", regardless of the dielectric constants of the said compound, characterized in that the said applicator is provided with at least one resonant cavity that extends around the waveguide, for treatment of the product.

More particularly, the invention relates to an energy applicator, of the type comprising a waveguide and lateral chimney members, for dielectric heating of any compound, at microwave frequencies or high frequencies, under static or dynamic conditions, at relative power density higher than that of the usual applicators, without risk of electric arcs or "discharge", regardless of the dielectric constants of the said compound, characterized in that the said applicator is provided with at least one chimney member of geometry adapted to form a resonant cavity around the waveguide, for treatment of the product under consideration, applicator such as described in the foregoing, characterized in that this cavity is formed on each side of the waveguide, applicator such as described in the foregoing, characterized in that this cavity is formed around the waveguide by one or more chimney members, applicator such as described in the foregoing, characterized in that the chimney member or chimney members is or are placed on each side of the waveguide, around the resonant cavity, applicator such as described in the foregoing, characterized in that the chimney members are of identical geometry.

In this context it will be noted that the geometries to be described reflect the surprising concept that it is possible to work usefully (meaning to treat the product) in a zone larger than that recognized unanimously in the prior art, or in other words a zone in which the constant prior art was careful not to work. The discovery of this principle has made it possible on the one hand to create new and original geometries, avoiding discharge, which was the first objective, and on the other hand to obtain, completely unexpectedly, a substantial savings in treatment time and investment costs. It has been demonstrated in a test that the time for treatment of 60 ml of product in the "zone" or cavity enlarged according to the invention was equal to the treatment time necessary for treatment of 33 ml of product in a crucible.

The uniqueness of these new chimney members derives from their shape. They are composed of two main portions: an upper portion, which must be as close as possible to the reactor in order to prevent waves from leaking out, and a lower portion whose shape flares toward the waveguide so that, according to the invention, electric arcs are reduced and the additional resonant cavity mentioned hereinabove is created around the waveguide.

The person skilled in the art will understand that the shape and dimensions of the said additional cavity around the waveguide, or in other words around the resonant cavity normally already present in the waveguide (which cavity is strictly limited in the prior art), can be entirely varied as a function of the envisioned application and of the apparatus.

In particular, there can be cited the symmetric shapes, and in particular the shapes composed of at least a conical base, a spherical shape or a shape of ellipsoidal or analogous volume, the broadest portion opening into the waveguide in all cases.

The upper portion of these new chimney members must be as close as possible to the reactor in order to prevent leakage of waves. This portion may have diverse shapes, such as cylindrical shapes with circular, rectangular or square cross section, without being limited thereto. It may also include a plurality of successive different shapes. Nevertheless, the most commonly used shape is the cylindrical shape with circular cross section, in order to conform best to the shape of the reactor and to avoid the presence of edges, which favor electric arcs. The height of this portion of the chimney member is determined from the viewpoint of excluding any leakage of waves.

The person skilled in the art will understand that this upper portion does not necessarily have to be present in the case of completely shielded systems. In this type of configuration, the problem of waves leaking out is effectively suppressed, because the entire system then represents a resonant cavity.

The lower portion of these chimney members must be of flared shape, in order to prevent electric arcs at the waveguide. For this purpose there can be cited, as non-limitative examples, the conical and/or spherical shapes having variable angles relative to the vertical, and the pyramidal shapes having square or rectangular bases. As in the foregoing, this portion of the chimney member may have a combination of these different shapes. The main parameter that must be taken into account is the base diameter of these flared shapes: it must not exceed the width of the waveguide. Once the diameter has been chosen, the height and apex angle of the flared portion are fixed as a function of the power used.

In the case of single-mode microwave applicators at 2450 MHz, the recommended waveguide width for remaining in TE 0.1 mode (transverse electric) ranges between approximately 70 and 100 mm. The TE 0.1 fundamental mode of excitation permits the wave to propagate along a single arc.

At less than 70 mm, the wave does not propagate (cutoff frequency).

At greater than 100 mm, the mode changes to TE 0.2, with two field maxima, implying less homogeneous heating.

The person skilled in the art will understand that the invention is also applicable at other microwave frequencies and high frequencies, and that similar reasoning can be advanced for all of these frequencies.

Although all geometric shapes and combinations thereof can be envisioned, it is advisable for reasons of simplicity and cost to work preferably with chimney members of identical shapes and dimensions on both sides of the waveguide and also with a minimum of combinations for each.

The invention will be more clearly understood by reading the description to follow and the non-limitative examples below.

In the attached FIGS. 1 to 15, the symbols have the following meanings:

MW milliwattmeter

SR' cooling system

I iris (a kind of adjustable diaphragm)

AP applicator with chimney member or chimney members

P short-circuit piston

BC double coupler

SA automatic stub system (insertable movable screws)

C safety device (circulator)

SR cooling systems

Figure 15:
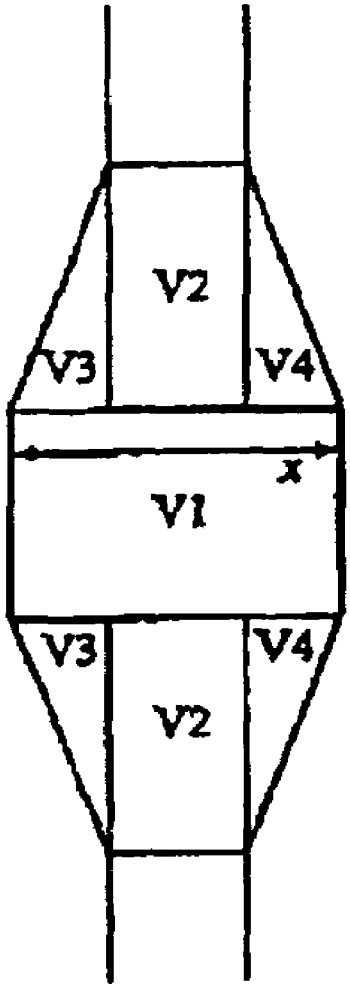
FIG. 15 shows a configuration of the chimney member according to one embodiment of the present invention.

TMO microwave head
G magnetron generator
GO waveguide
R reactor exposed to waves
CH chimney member or chimney members
PS upper portion of chimney member
Pi lower portion of chimney member
V1, V2, V3, V4 volumes (FIG. 15)

EXAMPLES

The examples below illustrate the interest of the invention as well as of its variants, and will permit the person skilled in the art easily to extrapolate to other dimensions and/or geometries without departing from the scope of the invention.

The following examples, which are in no way limitative, illustrate the merit of the invention. They are intended to demonstrate that the usual microwave and high-frequency applicators are not adapted to all products, and more particularly to weakly absorbing products. To be able to heat these products without risk of discharge, it is advisable to modify the shape of the chimney member of these applicators.

The examples also demonstrate the successive difficulties encountered in the development of the present invention.

I—Appliances Used

The microwave device comprises different elements: (see FIG. 1)

The microwave system is composed of a magnetron generator G operating at the frequency of 2450 MHz ($\lambda$=12 cm) at a power ranging up to 6 kW.

The generator transmits the energy to the microwave head TMO, which will transform the high voltages comprising the energy to microwaves.

The circulator C is a safety device, which allows the incident waves to pass and redirects the reflected waves to a water ballast, where the waves are absorbed, thus raising the water temperature.

The double coupler BC makes it possible to know the reflected and incident powers by virtue of the milliwattmeter MW.

The automatic stub system SA is composed of 4 insertable screws in the waveguide for the purpose of attenuating the reflected power of the system.

The iris I and the short-circuit piston P make it possible to adapt the microwave system to the substance to be treated. In other words, to favor better absorption by the substance of the power emitted by the generator, the electric field must be maximal at the location of the solution, which can be achieved by appropriate adjustment of these two elements.

The system is equipped with two cooling systems SR in order to prevent any overheating.

The substance is placed in the applicator AP, formed by single-mode cavities resonating at the emission frequency along a beam in the direction of the guide.

The pilot is adapted to the microwave system. It comprises the microwave reactor, positioned in the field of the waveguide. The tests can be performed under static or dynamic conditions.

II—Results:

The tests were performed by means of a 6-kW magnetron generator operating at the frequency of 2450 MHz. The single-mode applicator was constructed on the basis of a rectangular waveguide of 86 mm width and 43 mm height. In this type of applicator, the distribution of the electric field is localized and the Pyrex™ reactor is placed in maximum interaction therewith by virtue of a short-circuit piston. An impedance-matching device, placed between the generator and the applicator, also assures the adjustments necessary for optimal transfer of energy into the product to be treated.

The tests were performed under static and dynamic conditions.

Figure 3:
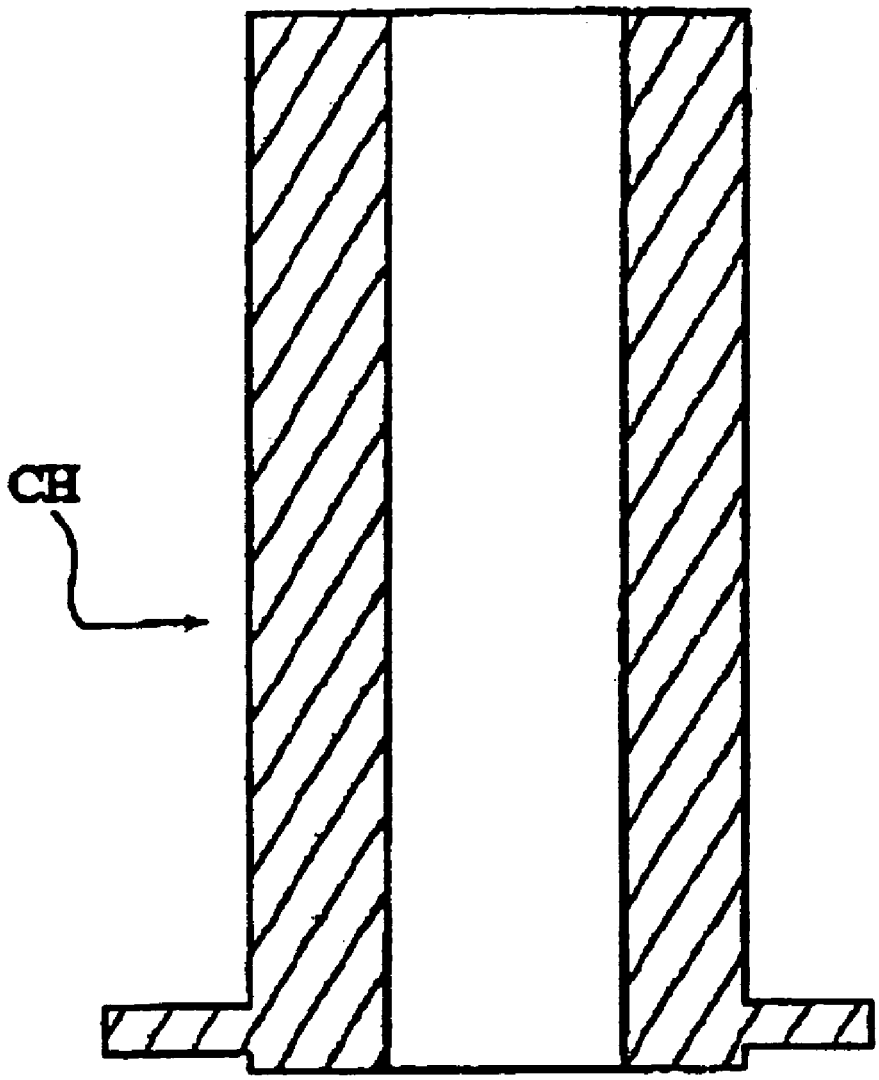
FIG. 3 is a cross sectional diagram of a chimney member according to one embodiment of the present invention.
Figure 4:
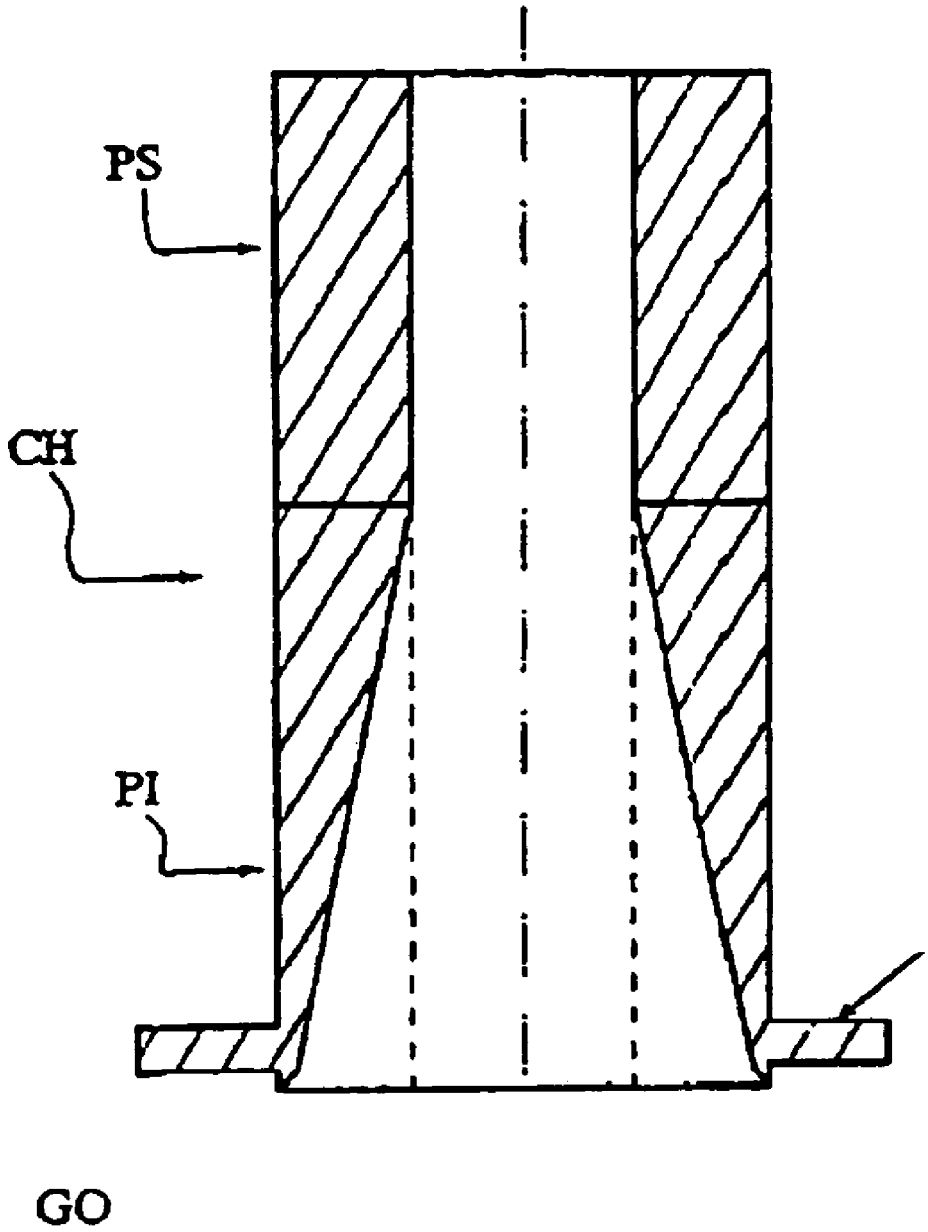
FIG. 4 is a cross sectional diagram of a chimney member according to one embodiment of the present invention.

Two types of chimney members CH were tested on two types of products:

standard cylindrical chimney members (see FIG. 3)
conical chimney members (see FIG. 4)

and water: polar molecule with good dielectric characteristics
rapeseed oil: molecule with poor dielectric characteristics The values of the dielectric characteristics of these products are presented in the table below:

| | Relative permittivity $\epsilon'$ | Loss factor $\epsilon''$ | Loss angle tan $\delta$ |
|---|---|---|---|
| Water | 80 | 20 | 0.25 |
| Rapeseed oil | 4.5 | 0.2 | 0.044 |

The experiments performed on 1.5 kg of product demonstrate the efficacy of these new chimney members:

| Chimney member | Tested power | Water | Rapeseed oil |
|---|---|---|---|
| Standard (cylindrical) | 2 kW | no arcs | arcs in 10 min |
| Conical (invention) | 4 kW | no arcs | no arcs |

III—Tests Performed

All tests were performed with rapeseed oil.

a—Test with Two Standard Chimney Members (Prior Art) of 95 and 65 mm Heights and a Microwave Reactor of 30 mm Diameter.

Figure 5:
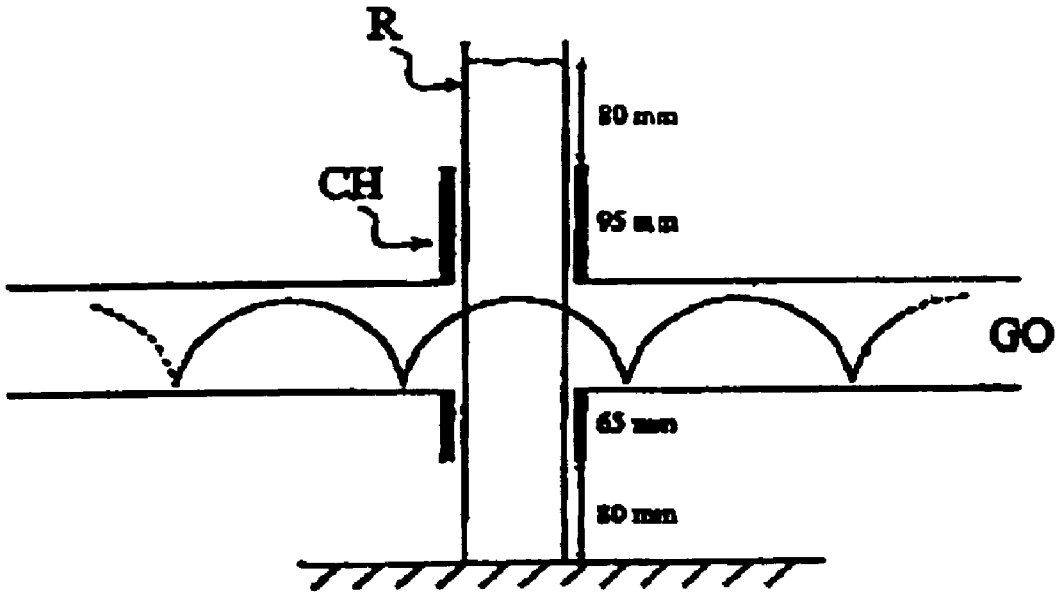
FIG. 5 is a cross sectional diagram of a chimney member and waveguide according to one embodiment of the present invention.

See FIG. 5

The test was performed on rapeseed oil with a microwave tube having an inside diameter of 30 mm and a height of 1 m.

| P emitted (kW) | P reflected (W) | Leaks (mW/cm$^2$) | Remarks |
|---|---|---|---|
| 0.5 | 160 | 0 to 0.2 | |
| 1 | 279 | 0.3 | |
| 2 | 600 | 0.4 | Arcs, glass deformed |

Figure 6:
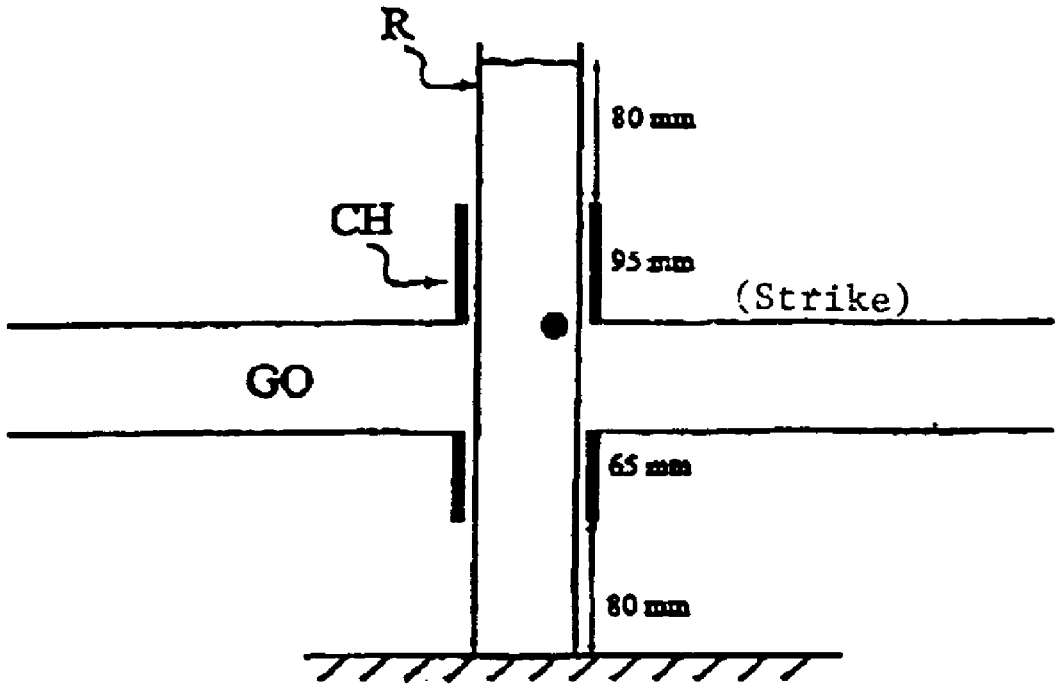
FIG. 6 is a cross sectional diagram of a chimney member and waveguide according to one embodiment of the present invention.
Figure 7:
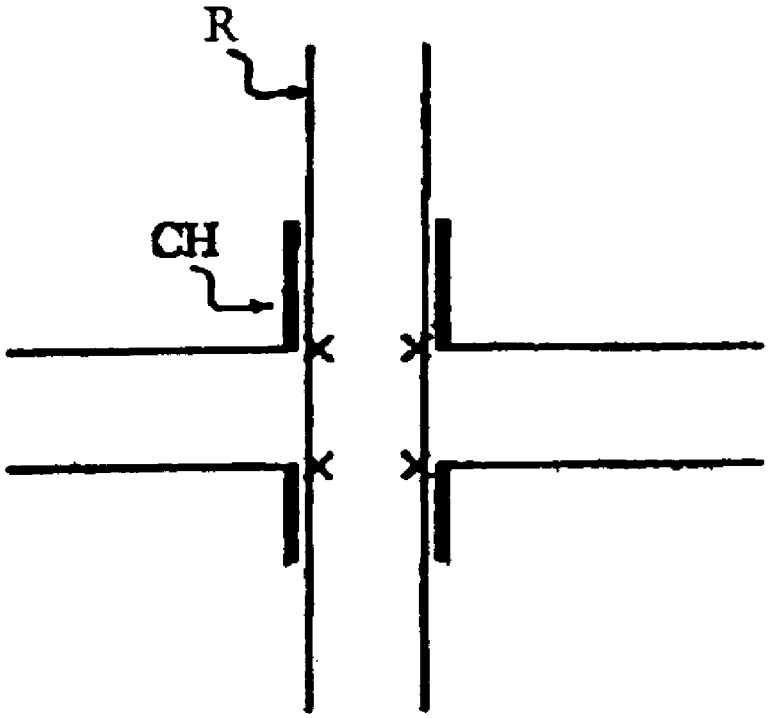
FIG. 7 is a cross sectional diagram of a chimney member according to one embodiment of the present invention.

At the moment when arcs began, the temperature was 240° C. The arcs did no break the glass, but deformed it. The strike occurred just at the beginning of the upper chimney member.

see FIG. 6

The places of the reactor that are most susceptible to arcs are those where the distance between waveguide and chimney member of the reactor is shortest. See FIG. 7

These arcs are caused by the fact that the electric field is too strong. Attempts were then made to increase the volume of product exposed to the field.

b—Chance of Configuration

The waveguide was modified in such a way as to expose a larger volume to the field.

Old Configuration

In the old configuration, the reactor traversed the waveguide at right angles to the direction of propagation of the waves.

Figure 8:
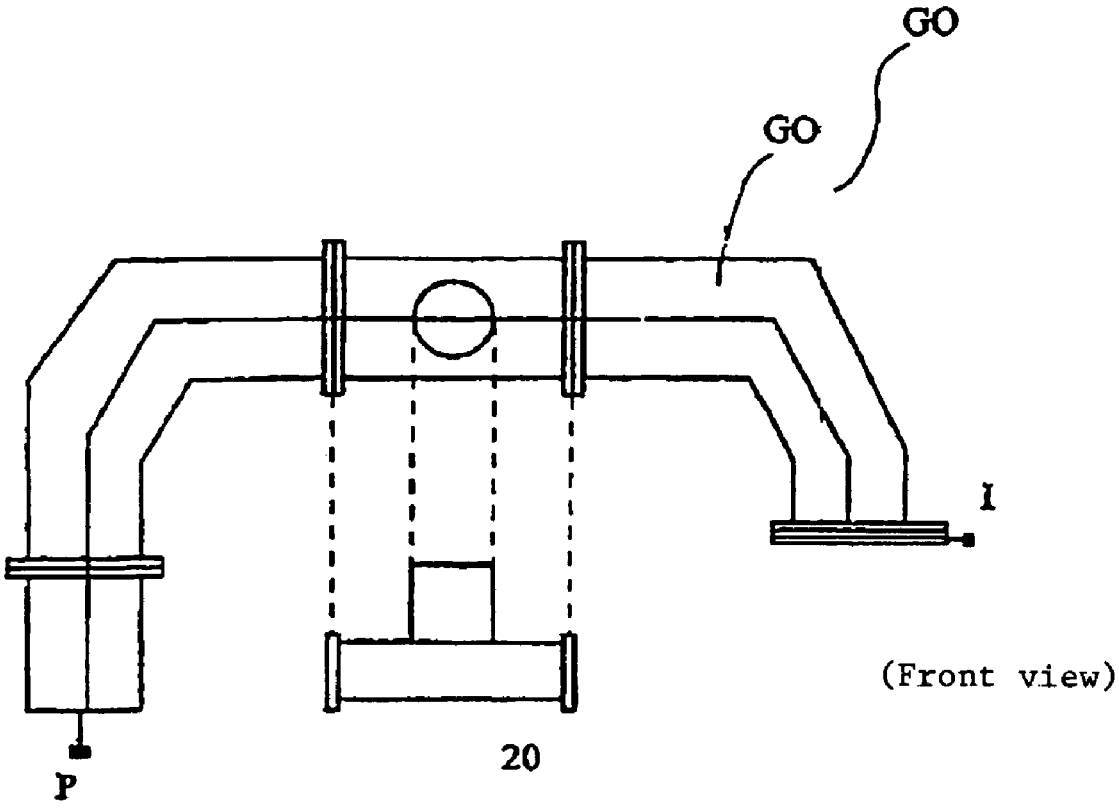
FIG. 8 is a cross sectional diagram of the reactor traversing the waveguide at right angles in the direction of propagation of the waves according to one embodiment of the present invention.

See FIG. 8

Figure 9:
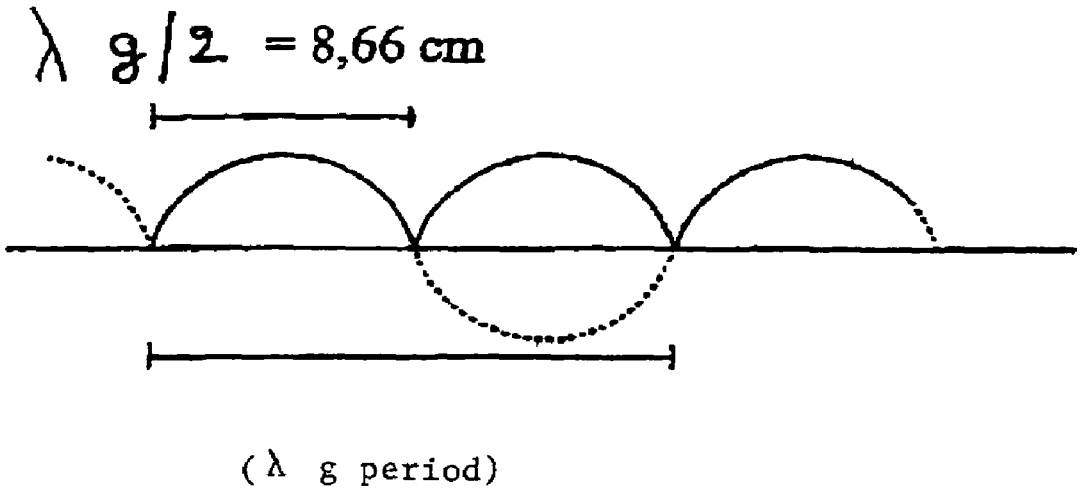
FIG. 9 shows wavelength characteristics of the configuration depicted in FIG. 8.
Figure 10:
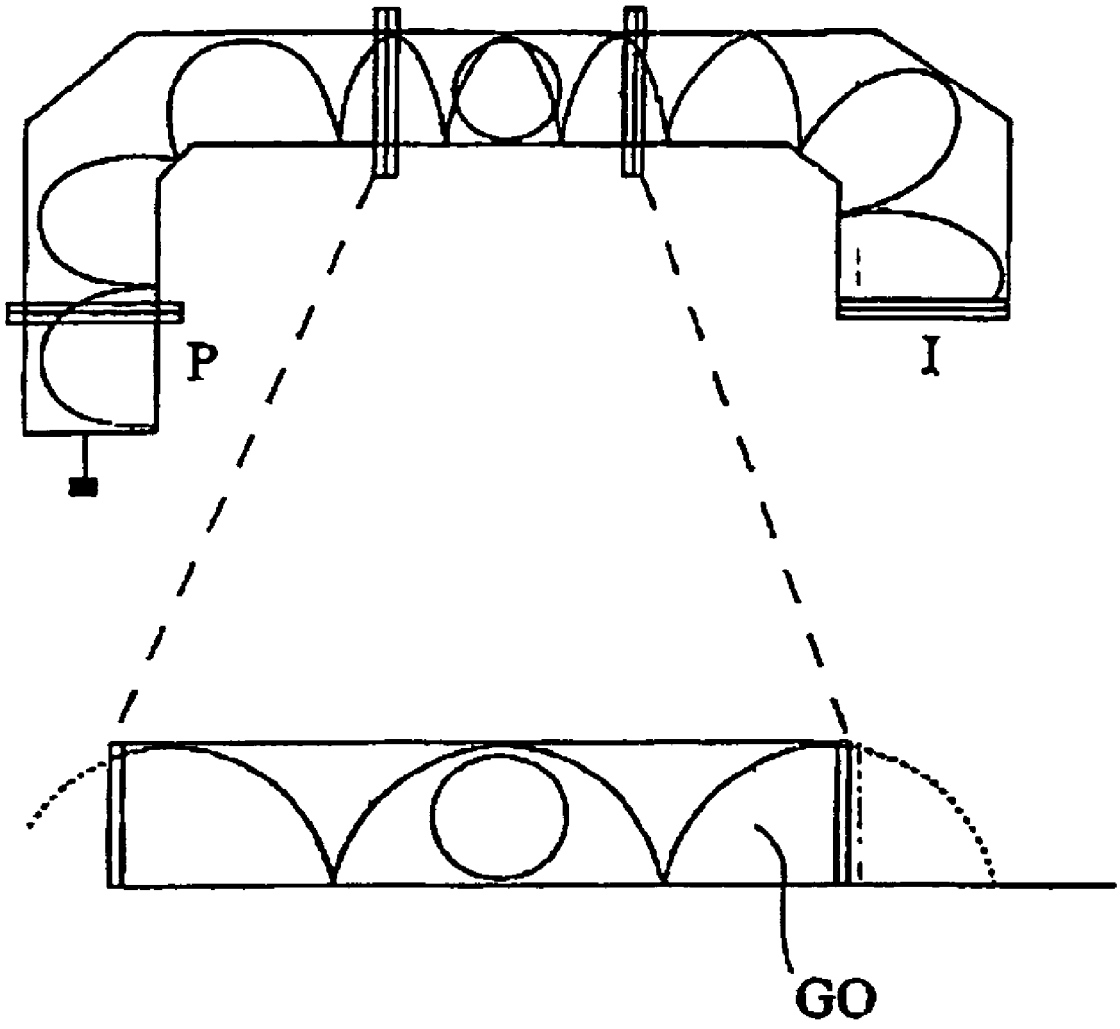
FIG. 10 shows a configuration of the chimney member, wave guide and reactor according to one embodiment of the present invention.

See FIGS. 9 and 10

Total length=77.86 cm

Since λg/2=8.66 then 8 (λg/2)=69.28 and 9 (λg2)=77.94

9 half-periods are counted between the iris and the piston

New Configuration

In the new configuration, the reactor traverses the waveguide parallel to the direction of propagation of the waves.

Figure 11:
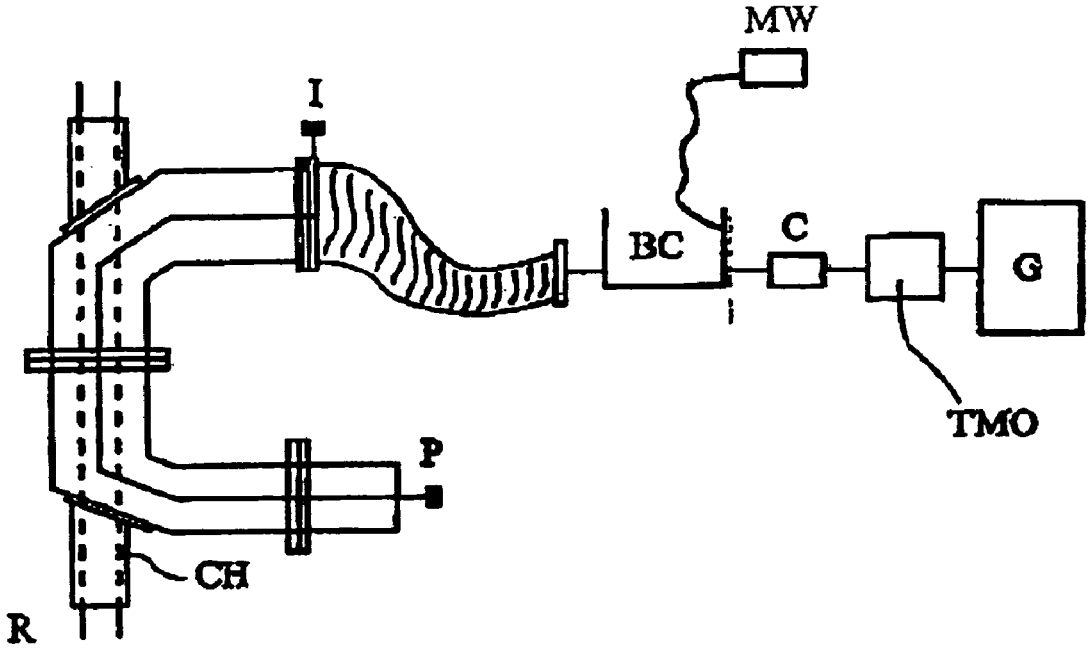
FIG. 11 shows a configuration of the chimney member, waveguide, reactor and wave-emitting device according to one embodiment of the present invention.
Figure 12:
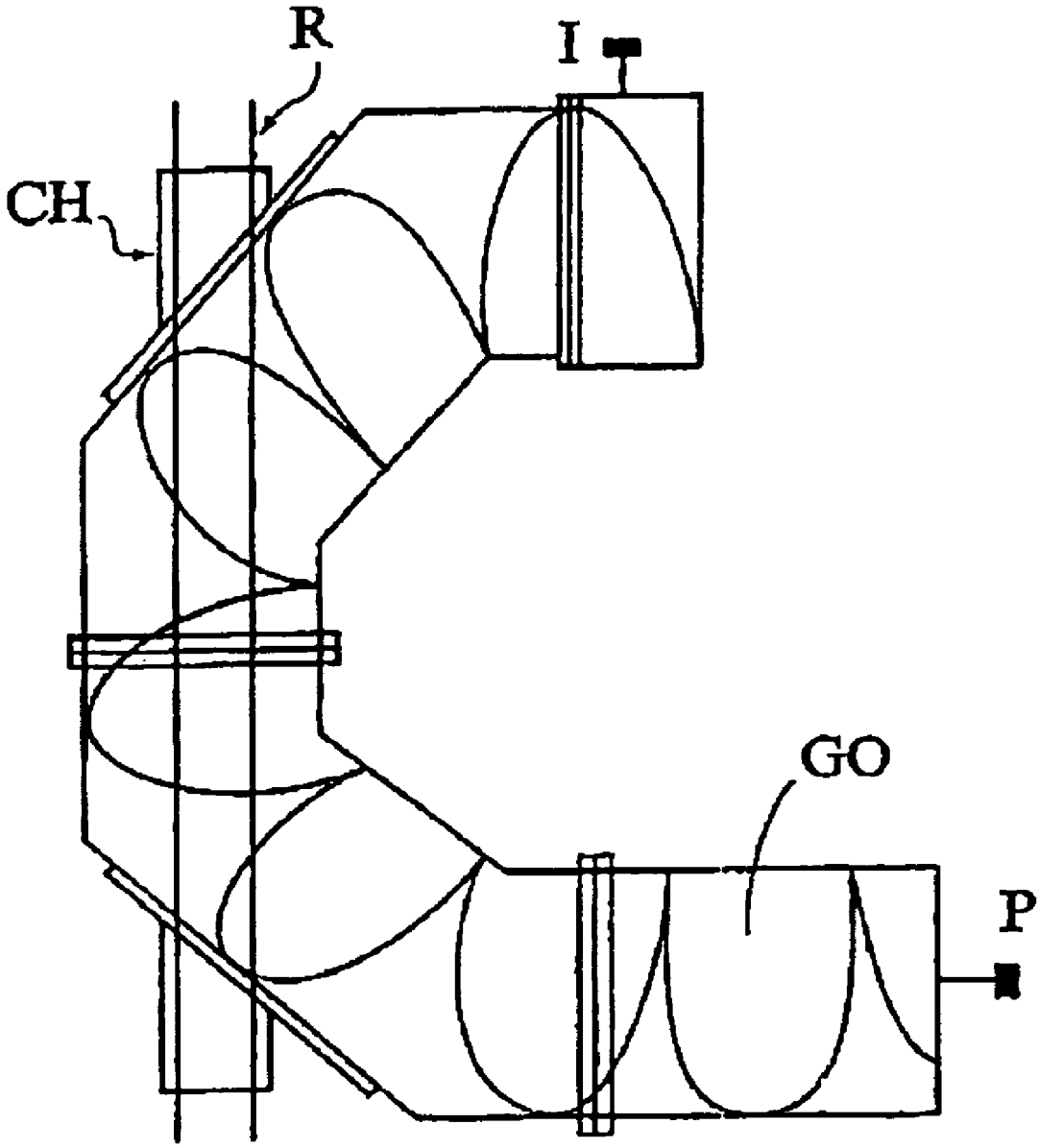
FIG. 12 shows a configuration of the chimney member, waveguide and reactor according to one embodiment of the present invention.

See FIGS. 11 and 12

Total length=63 cm 7 (λg/2)=60.62

8 (λg2)=69.28

Slightly more than 7 half-periods are counted between the iris and the piston.

The reactor was filled with rapeseed oil and power tests were performed.

At 5 kW, an arc developed in 5 minutes. At 2 kW, it appeared at the end of 36 minutes. In both cases, the temperature attained did not exceed the desired temperature level.

Figure 13:
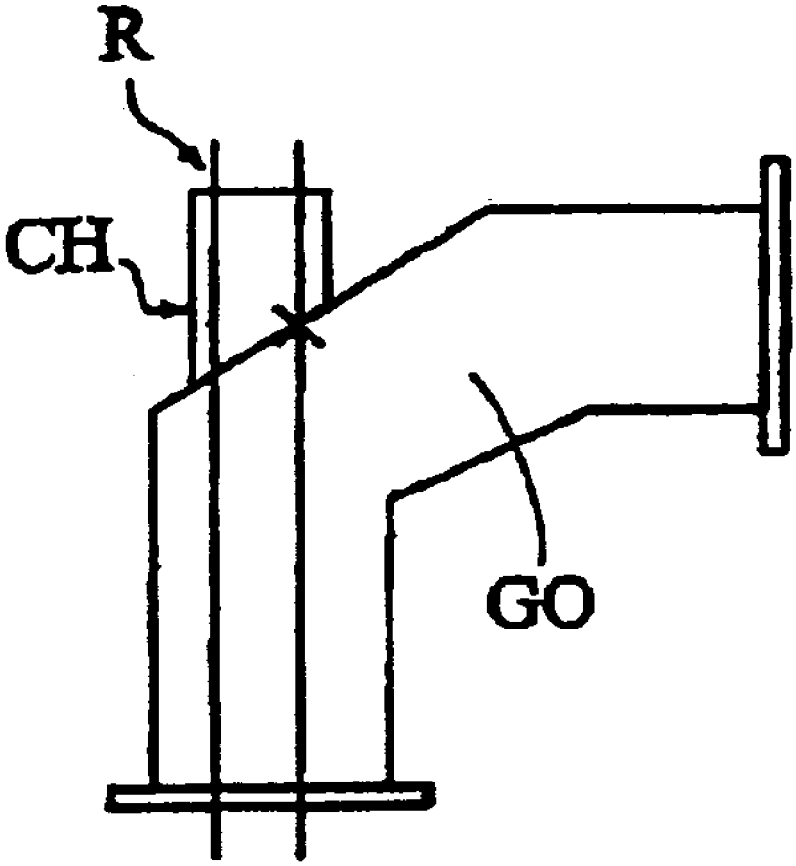
FIG. 13 shows a configuration of the chimney member, waveguide and reactor according to one embodiment of the present invention.

Once again, a single arc strike occurred at the junction between the chimney member of the reactor and the waveguide:

See FIG. 13

To limit the presence of electric arcs, it must therefore be ensured that the reactor is not too close to the waveguide.

The old configuration (vertical arrangement) achieved better results. The next tests were performed with this first configuration but with new shapes of chimney members.

c—Use of Conical Chimney Members

Two criteria must be taken into account:

1—the volume exposed to the field

2—the distance between the reactor and the waveguide constituted by the chimney member New chimney members are designed to meet these two criteria. They are characterized as conical. More precisely, they comprise a standard cylindrical portion and a conical portion at the level of the waveguide. They replace the straight cylindrical chimney members.

See FIGS. 3 and 4

Figure 14:
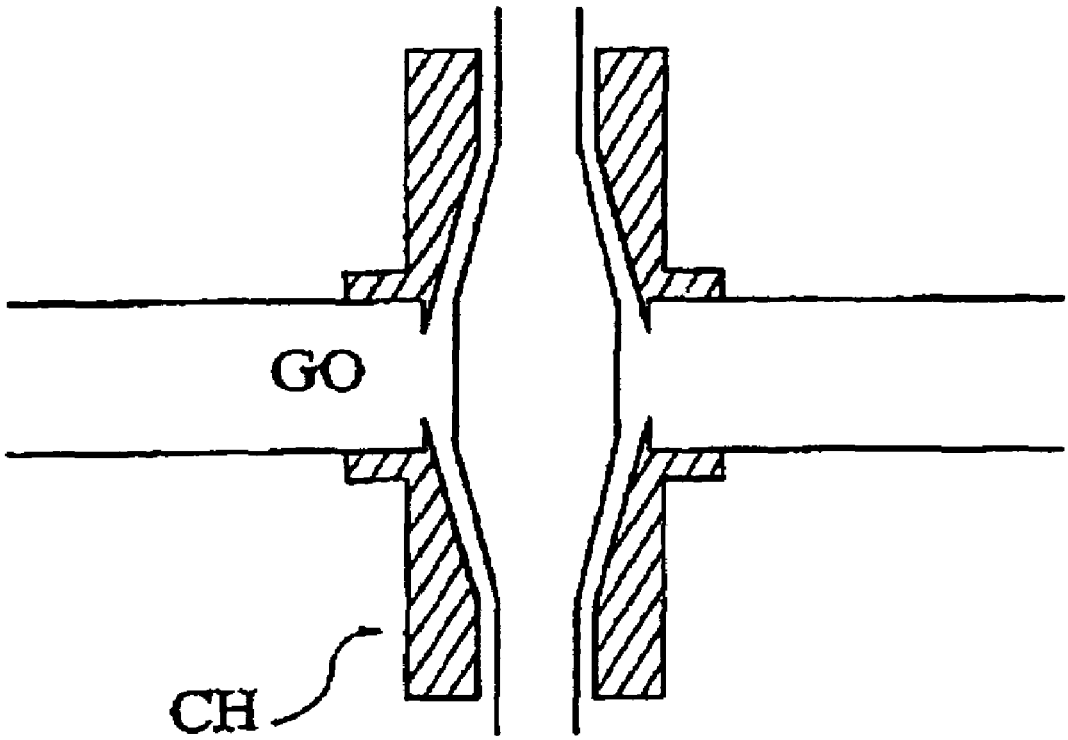
FIG. 14 shows a configuration of the chimney member and waveguide according to one embodiment of the present invention.

The microwave reactors can then have different shapes:

See FIGS. 14 and 15

With approximately:

$$V1=4.33*\Pi*x^2/4$$

$$V2=9.95*\Pi*3^2/4=70.33\ cm^2$$

$$V3+V4=9.95*\Pi*(x-3)^2/4$$

For x=3 cm, Vtotal=171.2 $cm^2$

For x=5 cm, Vtotal=282 $cm^2$

For x=6 cm, Vtotal=394.3 $cm^2$

Power tests at 4 kW were performed on reactors of 50 mm (x=5 cm) and 30 mm (x=3 cm) diameter.

With the 50-mm reactor, an arc developed at the end of 6 minutes. The reactor was too close to the waveguide.

In contrast, with the reactor having 30 mm diameter (straight reactor), no arc developed. The only arcs that can occur were observed when the reactor was weakly centered.

d—Ventilation by Humid Air

Additional tests were performed to optimize the results obtained with these new chimney members a little more.

The tests were performed with the conical chimney members and a straight reactor of 30 mm diameter (better conditions, see II-c).

To remove the static electricity, it is necessary to promote good ventilation by humid air or by another gas having comparable values of dielectric constants (example: SF6 at 1 bar). In the present case, water vapor was injected at the applicator. To prevent water from condensing on the reactor walls, it was necessary to add suction at the outlet of the chimney members.

With gentle suction, an arc developed at 282° C. and Pi=5 kW.

With very strong suction, an arc developed at 284° C. and Pi=6 kW. At 5 kW, however, no arc developed.

Ventilating with humid air therefore improves the results. Nevertheless, the ventilation must be sufficiently intensive to achieve a real effect.

Conclusions of the Tests:

The tests performed at 2450 MHz show that the system of chimney members in "conical" shape then makes it possible to avoid electric arcs at high emitted power (4 kW, instead of 2 kW with the standard chimney members). During operation at such powers, the desired temperature level (up to 400° C.) is reached very rapidly, or in other words in less than 15 minutes for the treatment of 1 kg of product.

It will be entirely preferable, without being limitative, to use the dimensions and shapes illustrated in FIG. 4, which represents the best embodiment of the invention to date. As is evident, a chimney member having a conical lower portion and a cylindrical upper portion is used in this case.

The invention also covers all the embodiments and all the applications that will be directly accessible to the person skilled in the art from reading this application, from his own knowledge and possibly from simple routine tests.

The invention claimed is:

1. An dielectric heating applicator, comprising:

a waveguide and lateral chimney members, for dielectric heating of any compound, at microwave frequencies or high frequencies, under static or dynamic conditions, with relative power density higher than that of the usual applicators, without risk of electric arcs or "discharge", regardless of the dielectric constants of the said compound, wherein the said applicator is provided with at least one resonant cavity chimney that extends around the waveguide, for treatment of the product.

2. An applicator according to claim 1, wherein the cavity is formed on each side of the waveguide.

3. An applicator according to claim 1, wherein the cavity is formed around the waveguide by one or more chimney members.

4. An applicator according to claim 3, wherein the chimney member or chimney members is or are placed on each side of the waveguide, around the resonant cavity.

5. An application according to claim 1, wherein the shape of the said cavity formed around the waveguide is chosen from among:

symmetric shapes, and shapes composed of at least a conical base, a spherical shape or a shape of ellipsoidal volume, the broadest portion opening into the waveguide.

6. An applicator according to claim 3, further comprising:

a plurality of chimney members of identical geometry.

7. An applicator according to claim 3, wherein the chimney members are composed of two main portions:

an upper portion, which must be close as possible to the reactor in order to prevent waves from leaking out, and a lower portion whose shape flares toward the waveguide to prevent electric arcs.

8. An applicator according to claim 7, wherein the upper portion of the chimney members must be as close as possible to the reactor in order to prevent leakage of waves, and it can have cylindrical shapes with circular, rectangular or square cross section.

9. An applicator according to claim 8, wherein the chimney members have a geometry composed of different successive shapes.

10. An applicator according to claim 8, wherein the upper portion of the chimney members has a cylindrical shape with circular cross section, in order to conform best to the shape of the reactor and to avoid the presence of edges, which favor electric arcs, the height of this portion of the chimney member is determined so as to exclude any leakage of waves.

11. An applicator according to claim 8, wherein the lower portion of these chimney members, or in other words that close to the waveguide, is of flared shape.

12. An applicator according to claim 11, wherein said shape is chosen from among the conical and/or spherical shapes having variable angles relative to the vertical, and from the pyramidal shapes having square or rectangular bases.

13. An applicator according to claim 11, wherein the base diameter of these flared shapes must not exceed the width of the waveguide, and then the height and apex angle of the flared portion are fixed as a function of the power used.

14. Applicators according to claim 1, wherein there are used single-mode microwave applicators at 2450 MHz, and in that the recommended waveguide width for remaining in TE 0.1 mode (transverse electric) ranges between approximately 70 and 100 mm, the TB 0.1 fundamental mode of excitation permitting the wave to propagate along a single arc.

15. Applicators according to claim 1, wherein there are used applicators operating at other microwave frequencies and at high frequencies.

16. Applicators according to claim 1, wherein the chimney members comprise an upper standard cylindrical portion and a lower conical portion at the waveguide.

17. Applicators according to claim 1, wherein there are used high-frequency applicators chosen from among the following:

applicators of capacitive type, formed from two capacitor foils between which there is applied the high-frequency voltage of the generator, the said applicators being used for heat treatment of materials whose volume comprises a parallelepiped in which one of the sides is sufficiently thick (>10 mm), rod applicators for flat materials, comprising tubular or rod electrodes, the said applicators being used for heat treatment of materials whose volume comprises a parallelepiped in which one of the sides is not sufficiently thick (<10 mm), applicators for thread-like materials, formed of loops, microwave applicators, chosen from among:

localized-field applicators: single-mode cavity, diffuse-field applicators: multimode cavity, near-field applicators: radiating-antenna guide.

18. Applicators according to claim 1, wherein a resonant microwave system is created by a localized-field or a diffuse-field applicator.

19. An applicator according to claim 18, wherein said localized-field or a diffuse-field applicator creates a "single-mode" system (localized field), which is formed from single-mode cavities resonating at the emission frequency along a beam in the direction of the guide.

20. An applicator according to claim 18, wherein said localized-field or a diffuse-field applicator creates a "multi-mode" system (diffuse field).

21. An applicator according to claim 3, wherein the length of each chimney member is determined so as to exclude any leakage of waves and to comply with the safety measures relating to personnel and telecommunications.

22. Use of the applicators or chimney members according to claim 1 for application of microwave or high-frequency electromagnetic waves for heating applications on compounds that absorb the radiation weakly and on compounds having high dielectric constants ($\epsilon'>5$ and $\epsilon\Delta>0.5$).

23. Applications according to claim 22 for performing heat treatments on compounds that absorb electromagnetic waves weakly or on polar or polarized compounds.

24. Applications according to claim 22 for the treatment of fatty acid esters (unsaturated or otherwise), of hydrocarbons (unsaturated or otherwise), of aromatic compounds and of derivatives of the latter, and of products that absorb electromagnetic waves, to increase the production capacity of a given system (fatty and non-fatty alcohols, carboxylic acids, amines, etc.), and for all reactions of "lipochemistry", with in particular a very strong interest for the case of products that absorb electromagnetic waves weakly, such as for isomerization of fatty acids or of esters of monounsaturated or polyunsaturated fatty acids, or of waxes, and in particular of castor oil.

25. Applications according to claim 22, wherein there are achieved all the heating applications involving a single reactant or a mixture of reactants in variable proportions, such as esterification, transesterification, epoxidation, sulfatization, phosphatization, amidification, polymerization and polycondensation reactions as well as decolorization, deodorization and the systems for elimination of volatile compounds.

26. Applications according to claim 22 for synthesis of polymers of unsaturated fatty acids, of esters of unsaturated fatty acids, of esters of unsaturated fatty acids, or unsaturated hydrocarbons or of derivatives of such products by dielectric heating with microwave.

27. Applicators according to claim 11 wherein there are used chemical agents chosen from among the following:

the products that absorb electromagnetic waves weakly or the products that absorb strongly or a mixture of the two, with or without additions of catalysts or weakly or strongly absorbing additives, strongly absorbing products: the fatty or non-fatty alcohols, fatty or non-fatty amines, carboxylic acids, acetals, ketones, enols, peracids, epoxides and chemical compounds containing a polar or polarized function, as alcohols: sorbitol, glycerol, mannitol, glycols, vitamins (such as tocopherol, ascorbic acid, retinol), polyphenols, sterols (including the phytosterols) and as amines: ammonia, primary, secondary and tertiary alkylamines (methylamine, dimethylamine, trimethylamine, diethylamine), the fatty amines (oleic amines, alkylamines of coconut oil), the aminoalcohols, (monoethanolamine MEA, diethanolamine DEA, triethanolamine TEA; 3-amino-1,2-propanediol, 1-amino-2-prop anol) and ethoxylated amines (2,2'-aminoethoxyethanol; amino-1-methoxy-3-propane), saturated or unsaturated, straight-chain or branched, catalysts or additives: the acid catalysts such as paratoluenesulfonic acid, sulfuric acid, phosphoric acid, perchloric acid, etc., the basic catalysts such as sodium hydroxide, potassium hydroxide, alkali metal and alkaline earth alcoholates, sodium acetate, triethylamines, pyridine derivatives, etc., the acid and/or basic resins of the Amberlite™, Amberlyst™, Purolite™, DoweX™ and Lewatit™ type, zeolites, enzymes and carbon blacks, weakly absorbing products: the animal or vegetable oils and fats and the polyterpenes, some of which are derived from the said oils and fats, oils or fats of animal origin: sperm oil, dolphin oil, whale oil, seal oil, sardine oil, herring oil, shark oil, cod-liver oil, neatsfoot oil and beef, pork, horsemeat and mutton fats (suets), oils of vegetable origin: rapeseed oil, sunflower-seed oil, peanut oil, olive oil, walnut oil, corn oil, soybean oil, linseed oil, hemp oil, grape-seed oil, coconut oil, palm oil, cottonseed oil, babassu oil, jojoba oil, sesame oil, castor oil, dehydrated castor oil, hazelnut oil, wheat-germ oil, borage oil, onager oil and tall oil, components of animal or vegetable oils: squalene, extracted from the unsaponifiable fractions of vegetable oils (olive oil, peanut oil, rapeseed oil, corn-germ oil, cottonseed oil, linseed oil, wheat-germ oil, rice-bran oil), or the squalene contained in shark oil, the said oils and fats of animal or vegetable origin as well as the derivatives thereof being capable of being subjected to a preliminary treatment aimed at making them more reactive or, on the other hand, less reactive, unsaturated hydrocarbons: an alkene, such as a terpenoid hydrocarbon or hydrocarbons, meaning a polymer or polymers of isoprene, or a polymer or polymers of isobutene, styrene, ethylene, butadiene, isoprene or propene, or a copolymer or copolymers of these alkenes, individually or in mixtures, monounsaturated or polyunsaturated fatty acids or fatty acid esters, waxes, castor oil.

28. An dielectric heating applicator, comprising:

a waveguide and lateral chimney members, for dielectric heating of any compound, at microwave frequencies or high frequencies, under static or dynamic conditions, at relative power density higher than that of the usual applicators, without risk of electric arcs or "discharge", regardless of the dielectric constants of the said compound, wherein said applicator is provided with at least one chimney member of geometry adapted to form a resonant cavity around the waveguide, for treatment of the product under consideration.

29. Chimney members for energy applicators for dielectric heating of any compound at microwave frequencies or high frequencies, under static or dynamic conditions, with high power density, without risk of electric arcs or "discharge", regardless of the dielectric constants of the said compound, wherein the said chimney members are such as described in claim 1.

* * * * *

UNITED STATES PATENT AND TRADEMARK OFFICE

CERTIFICATE OF CORRECTION

PATENT NO. : 7,202,453 B2
APPLICATION NO. : 10/482778
DATED : April 10, 2007
INVENTOR(S) : Pierre Charlier De Chily et al.

It is certified that error appears in the above-identified patent and that said Letters Patent is hereby corrected as shown below:

Column 13, line 51, "TB 0.1" should read --TE 0.1--.

Signed and Sealed this

Twenty-eighth Day of August, 2007

JON W. DUDAS
*Director of the United States Patent and Trademark Office*